US007497030B2

(12) United States Patent
Belgard

(10) Patent No.: US 7,497,030 B2
(45) Date of Patent: Mar. 3, 2009

(54) INTEGRAL LINT FILTER FOR CLOTHES DRYERS

(76) Inventor: Richard A. Belgard, 15571 Peach Hill Rd., Saratoga, CA (US) 95070

( * ) Notice: Subject to any disclaimer, the term of this patent is extended or adjusted under 35 U.S.C. 154(b) by 228 days.

(21) Appl. No.: 11/341,400

(22) Filed: Jan. 26, 2006

(65) Prior Publication Data

US 2007/0113419 A1 May 24, 2007

Related U.S. Application Data

(60) Provisional application No. 60/739,328, filed on Nov. 23, 2005.

(51) Int. Cl.
*F26B 21/06* (2006.01)

(52) U.S. Cl. ..... 34/82; 34/140; 34/235

(58) Field of Classification Search ..... 34/487, 34/480, 72, 79, 82, 134, 140, 235; 285/330, 285/913, 914, 361
See application file for complete search history.

(56) References Cited

U.S. PATENT DOCUMENTS

| | | | | |
|---|---|---|---|---|
| 4,000,919 | A * | 1/1977 | Edwards et al. | 285/111 |
| 5,045,192 | A * | 9/1991 | Terhune | 210/232 |
| 5,121,948 | A | 6/1992 | Anderson et al. | |
| 5,145,217 | A * | 9/1992 | Anderson et al. | 285/179 |
| 5,672,273 | A * | 9/1997 | Ball | 210/448 |
| 5,675,908 | A | 10/1997 | Barnes | |
| 5,970,623 | A | 10/1999 | Tuggle | |
| 6,098,312 | A | 8/2000 | Tuggle | |
| 6,378,227 | B1 | 4/2002 | Bradford | |
| 6,640,461 | B1 | 11/2003 | Berger | |
| 6,808,544 | B1 * | 10/2004 | Rodriguez | 55/385.1 |
| 6,938,640 | B2 | 9/2005 | Mustoe | |
| 2004/0074538 | A1 * | 4/2004 | Ortenzi et al. | 137/493.4 |
| 2004/0124129 | A1 * | 7/2004 | Booth | 210/232 |

FOREIGN PATENT DOCUMENTS

JP 06205894 A * 7/1994

OTHER PUBLICATIONS

U.S. Appl. No. 60/739,328, Rich Belgard.

* cited by examiner

*Primary Examiner*—Jiping Lu
(74) *Attorney, Agent, or Firm*—Donald R. Boys; Central Coast Patent Agency, Inc

(57) ABSTRACT

A lint filter assembly for removing lint and particulate matter from a clothes dryer exhaust system includes a conduit adapter and a filtering element. In a preferred embodiment the lint filter is a secondary filter removably connected inline between conduits substantially at the point of communication of the exhaust gases through a wall or floor to the outside, the filter portion not exceeding the conduit size in diameter.

1 Claim, 5 Drawing Sheets

INTEGRAL LINT FILTER FOR CLOTHES DRYERS

CROSS-REFERENCE TO RELATED APPLICATIONS

The present application claims priority to provisional application Ser. No. 60/739,328 filed on Nov. 23, 2005.

BACKGROUND OF THE INVENTION

1. Field of the Invention

The present invention is in the field of mechanical dryer utilities and pertains particularly to configurations providing secondary filters including lint traps used in clothes dryer systems.

2. Discussion of the State of the Art

Contemporary clothes dryer systems are well known in the art and generally embody a cabinet type utility having a front wall, rear wall, opposing sidewalls, top wall, and, optionally, a bottom wall. Clothes dryers are available in electrical models, in which heat is generated via a resistance element or via a "heat pump" method. Clothes dryers are also available such that heat is generated by a gas combustion chamber. In either case, a drum is typically provided for containing the clothes to be dried. In process, the drum containing clothes to be dried is rotated, and heated air is either forced into the drum or drawn out through the drum. The heated air passing though the clothes in the drum carries water in the clothes to an external exhaust vent. Heated air typically is passed through an existing lint filter at or near its egress within the clothes dryer. The exhaust then travels through a vent to the open air. The existing lint filter traps lint and particulate created during drying to prevent or reduce lint and particulate buildup of those in the egress path to the vent.

A conduit, typically made of sheet metal, is attached to the clothes dryer to route the exhaust air after it passes though the existing filter to the exhaust vent. The clothes dryer conduit exits the cabinet walls from either the rear or the side of the dryer cabinet, as provided by the dryer manufacturer. The physical space allocated for the clothes dryer often restricts the placement of the exhaust conduit.

The clothes dryer conduit is conventionally attached to a flexible extension conduit, which then may be attached to a vent, or, alternatively, the flexible extension conduit may be attached to a fixed extension conduit and ultimately to the exhaust vent. Sometimes the extension conduit is routed in a way to make it unobtrusive, and, as a consequence, difficult to access. For example, the extension conduit may be routed between an inner and outer wall of a house to the roof or other convenient vent location. It may also be routed under a sub floor to a crawl space to an appropriate exhaust wall. It may also be routed within a concrete sub floor or slab. The extension conduit may make turns, such as 90 degree turns, on its routing to the vent. Typically, the extension conduit is 20 feet or less in length.

The existing traditional lint filter traps lint and other particulate material present in the exhaust air in order to keep the extension conduit clean. Since lint and other materials are typically moist, those that escape the filter have a tendency to adhere to the walls of the extension conduit. Over time the extension conduit may eventually become clogged. Flexible conduit is corrugated and is particularly prone to lint buildup. As is generally accepted in the art, a build-up of lint and/or other particulate material in the extension conduit not only decreases the efficiency of the clothes dryer by reducing moist air flow, it also can sufficiently interrupt the air flow such that the heat and heated air, alone or in combination with built-up lint, becomes a fire hazard.

Existing lint filters are typically constructed of fine mesh material or metallic screen, and may be made of synthetic material, such as a nylon mesh. Due to the fineness of the mesh and of the material, these lint filters may eventually become perforated during manual lint removal and these lint filters can become perforated or destroyed. Traditional lint filters typically are easily removable for cleaning, and sometimes are not replaced when the dryer is operated. Furthermore, although the existing lint filter removes much of the lint and other material in moist exhaust air, it does not remove all of it. Over time, substantial buildup of lint and other material may clog the extension conduit causing interrupted airflow, poor drying efficiency, or even a fire.

The inventor is aware of the existence of secondary "outboard" lint filters known in the art. These "outboard" lint filters are box-type filters which may be added between the clothes dryer conduit and the flexible extension conduit, or, alternatively, between the flexible clothes dryer conduit and the exhaust vent. One such filter is referenced herein as U.S. Pat. No. 5,675,908 entitled "Clothes Dryer Lint Receptacle" invented by Paul S. Barnes and referred to hereinafter simply as Barnes. Barnes describes an externally mounted lint filter receptacle formed as an enclosure that may be mounted to a wall to which an exhaust hose from a clothes dryer may be attached. A screen mesh is provided within the enclosure to remove lint and particulate from exhaust air before it is vented to the outside.

One problem with the receptacle of Barnes is that the area of filtration is much larger than the standard inside diameter of the hose causing an interruption or a weakening in airflow in the exhaust system. Another problem with the receptacle of Barnes is that is requires physically mounting the receptacle to a wall through which an egress path is planned. Barnes also brings to light several other references to U.S. patents that employ some type of filtering scheme for exhaust air emanating from a dryer however, all of those devices are complex with more than one moving part, and must be assembled, or otherwise require much work and attention to operate correctly. Likewise, all but one of those inventions filters air for release internally to the building area hosting the clothes dryer. Further problems exist in that the receptacle of Barnes and those systems referenced by Barnes are not installable in a fashion that might be convenient for a user given the typically restricted space between the back wall of clothes dryer and the opposing house or building wall that the dryer is positioned in front of.

Therefore, what is clearly needed is an integral lint filter for a clothes drying system that may be conveniently installed between the exhaust port on the dryer and an exhaust conduit or hose without requiring much installation work, and that may be simply removed for cleaning and replaced for further use.

SUMMARY OF THE INVENTION

A lint filter assembly for removing lint and particulate matter from a clothes dryer exhaust system is provided. The lint filter assembly includes a conduit adapter and a filtering element. In a preferred embodiment, the conduit adapter includes a male conduit interface and a female conduit interface. In one embodiment, the conduit adapter includes two distal male conduit interfaces. In another embodiment, the conduit adapter includes two distal female conduit interfaces.

In a preferred embodiment, the filtering element is one of a metallic wire mesh or nylon mesh material. In one embodiment, the filtering element includes a support flange, the flange installable to the conduit adapter. In a variant of this embodiment, the flange is collapsible and memory resilient.

In an alternate embodiment, the adapter includes a filter support ring aligned in a substantially concentric arrangement therewith and supported in position by three or more support ribs. In a preferred embodiment, the filtering element does not exceed the conduit adapter in diameter.

According to another aspect of the present invention, a lint filter assembly for removing lint and particulate matter from a clothes dryer exhaust system is provided. According to this aspect, the lint filter assembly includes a conduit adapter assembly and a filtering element. In a preferred embodiment, the conduit adapter assembly includes a threaded seat and a threaded plug. In one embodiment, the conduit adapter assembly is manufactured of polyvinyl chloride plastic.

In a preferred embodiment, the conduit adapter assembly includes a male conduit interface and a female conduit interface. In one embodiment, the conduit adapter assembly includes two distal male conduit interfaces. In another embodiment, the conduit adapter assembly includes two distal female conduit interfaces. In a preferred embodiment, the filtering element does not exceed the conduit adaptor assembly in diameter.

According to one aspect of the present invention, a gas-exhaust assembly for a clothes dryer system is provided. The gas-exhaust assembly includes a primary lint filter, two or more conduit sections, and a secondary lint filter, including a conduit adapter or adapter assembly and a filtering element. The gas-exhaust assembly is characterized, in one embodiment, in that the secondary lint filter is removably connected inline between conduits substantially at the point of communication of the exhaust gases through a wall or floor to the outside, the filter element not exceeding the conduit size in diameter.

In one embodiment of this aspect, the adapter or adaptor assembly includes a filter support ring aligned in a substantially concentric arrangement therewith and supported in position by three or more support ribs. In one embodiment, the filtering element includes a flange supporting the filtering element, the flange installable to the conduit adapter or adaptor assembly. In a variation of this embodiment, the flange is collapsible and memory resilient.

According to another aspect of the present invention, a method is provided for preventing lint deposits on conduit of an exhaust system generic to a clothes dryer during a drying cycle. The method includes the acts (a) collecting lint onto a first lint filtering device, and (b) collecting lint escaping the first filtering device onto a second filtering device. The second filtering device includes a conduit adaptor or conduit adaptor assembly, and a filtering element. In a preferred aspect, in act (b), the filtering element does not exceed the conduit adapter or conduit adapter assembly in diameter.

In yet another aspect of the present invention, a method for installing a secondary lint filter assembly into a gas exhaust assembly of a clothes dryer system, the gas exhaust assembly including a first and second conduit juncture, the conduit junctures connected for communication by a flexible conduit section. The installation method includes the acts (a) disconnecting an end of the flexible conduit section at the second conduit Juncture, (b) positioning the secondary filter assembly to be inserted into an opening defined by the conduit juncture exposed by step (a), (c) urging the secondary filter assembly into the opening until seated therein and, (d) fastening the removed end of the flexible conduit section over the exposed adapter portion of the secondary filter system.

BRIEF DESCRIPTION OF THE DRAWING FIGURES

DETAILED DESCRIPTION

Figure 1A:
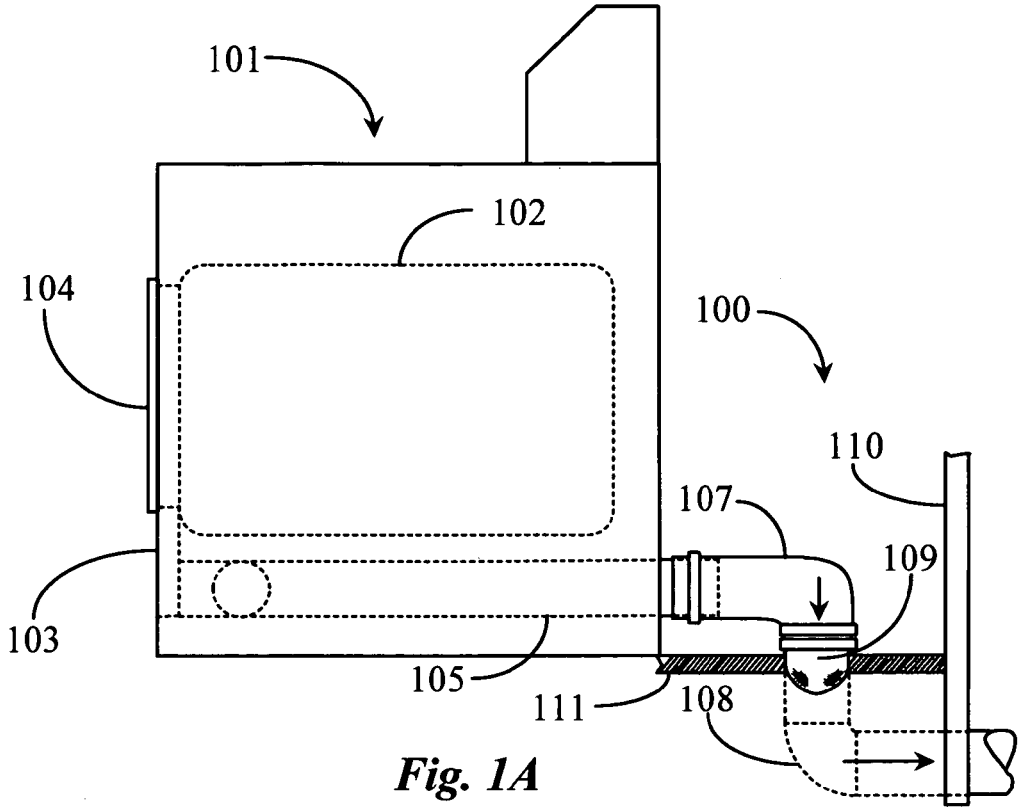
FIG. 1A is a side view a clothes dryer and exhaust system enhanced with an integral lint filter according to an embodiment of the present invention.

FIG. 1A is a side view of a clothes dryer 101 and exhaust system 100 enhanced with an integral lint filter 109 according to an embodiment of the present invention.

Figure 1B:
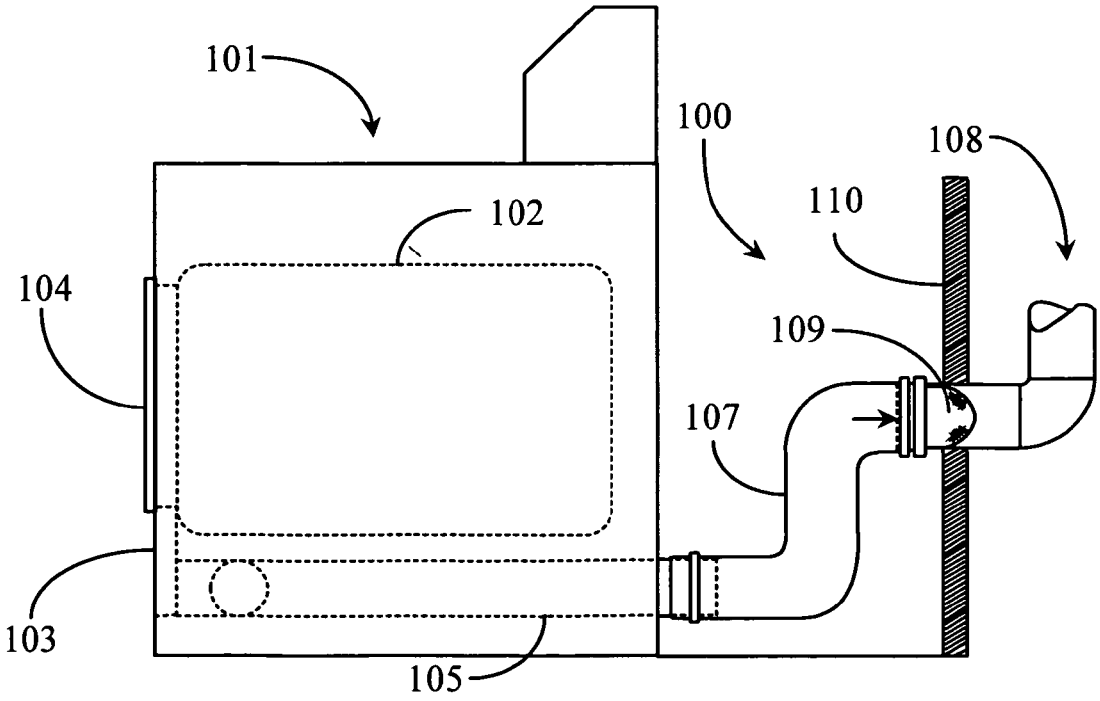
FIG. 1B is a side view of the system of FIG. 1A with an alternative exhaust conduit path.

FIG. 1B is a side view of the system of FIG. 1A with an alternate conduit exhaust path.

Referring now to FIG. 1A, a typical implementation for clothes dryer system 101 is illustrated in this example. The implementation includes clothes dryer system 101 strategically placed next to a building wall 110. This implementation is typical of a washroom or other semi-enclosed building space adapted with the proper outlets plumbing and exhaust portage for accommodating a washer and dryer system. It may be appreciated by one with skill in the art of typical implementations that the space afforded between system 101 and wall 110 to accommodate exhaust assembly 100 is most often very minimal. Therefore, it is an object of the present invention to provide a secondary filtering device that may be easily installed and removed in such cramped working space.

Clothes dryer system 101 may vary somewhat in design and architecture without departing from the spirit and scope of the present invention. In this example, clothes dryer system 101 is a typical configuration having a rotabaly mounted drum 102 for drying clothes; drum 102 housed within an enclosure including a top and bottom wall, and four side walls. Clothes dryer system 101 is not limited to a typical 4-wall architecture that may be easily moved about. In one embodiment, clothes dryer system 101 may be a provided as an in-wall system whereby access to the internal drum and controls for operating the system are provided in line with the wall surface and other access panels might be provided inconspicuously in the design for enabling access to other system components such as exhaust conduit.

In this simple embodiment, clothes dryer system 101 includes a dryer door 104 adapted to enable access to drum 102. Clothes dryer system 101 has a lint filter 103 provided thereto and made accessible in typical fashion such as through a lint drawer operable to enable removal of lint that accumulates during the clothes dying process. Filter 103 may include a lint catching screen and a lint compartment whereby the screen is easily removable so that lint may be removed. Clothes dryer system 101 has internal conduit 105 provided therein and adapted as an egress for hot air passing through the system to the outside of the system.

In one embodiment, a dryer fan (not illustrated) may be provided to help move hot air out of system 101 through internal egress conduit 105. A dryer fan may be implemented having an inlet portion in direct communication with a lint filter compartment and an outlet portion having direct communication with the receiving end of conduit 105. In this way hot air is urged out to exhaust through conduit 105. In typical manufacturing designs, conduit 105 is routed to and partially through a rear wall of clothes dryer system 101 as is illustrated in this example. However other egress paths are possible without departing from the spirit and scope of the present invention. For example, exhaust conduit 105 might be routed out through a side panel rather that a rear panel and so on.

At the rear of clothes dryer system 101, conduit 105 extends through and beyond, to an extent, the rear wall of system 101. Conduit 105 may be presumed annular in construction and may be manufactured of sheet metal or some other rigid or semi-rigid materials. A system-external exhaust conduit section 107 is provided as part of external exhaust system 100 and is adapted through dimensioning to fit over and to be affixed to an external portion or interface of conduit 105 at the point of egress through the rear wall of clothes dryer system 101. Conduit 107 may be held onto the external interface portion of conduit 105, in a typical configuration, via a hose clamp or spring clamp. In the case of a solid piece of conduit 107, the inside diameter of section 107 may be slightly larger than the outside diameter of conduit 105 so as to encourage a snug slip fit.

Exhaust conduit 107 may be, and most often is, a flexible conduit instead of a rigid conduit so that it may be variously routed as opposed to assumption of a fixed or semi-fixed position as may be the case of a rigid or semi-rigid piece or section of conduit. Flex conduit enables flexibility for close quarter routing of exhaust from the point of egress from clothes dryer system 101 to a duct in a floor or wall to facilitate exhausting of gases out of the enclosure to the outside. For example, conduit 107, if flexible, might be routed in the path of a right angle or elbow, or in the path of an "S" depending on the installation and duct location. In this example, conduit 107 is a flexible conduit with female ends, one of which is fastened over conduit 105 where it is exposed at the rear of clothes dryer system 101. A hose or spring clamp provides a secure attachment.

An outside exhaust conduit or duct section 108 is provided in this embodiment to carry exhaust from clothes dryer system 101 through a floor 111, in this example, and eventually through wall 110 to the outside. In one embodiment, section 108 is a rigid annular conduit manufactured of sheet metal or some other rigid or semi-rigid material, a portion thereof extending through floor 111 and a portion thereof extending through wall 110 to the outside. Section 107 is a flexible conduit adapted dimensionally to fit over the portion of section 108 extending up through floor 111. A hose clamp or spring clamp may be used to secure the connection. Still in other embodiments there may be other egress architectures implemented including those of varied materials and methods of attachment.

An integral and modular lint filter assembly 109 is provided inline as part of the egress exhaust path 100 of clothes dryer system 101. Filter assembly 109 is annular in construction and is, in a preferred embodiment, provided as an integral and secondary filter system adapted to filter out lint and particulate matter that may have escaped primary lint filter 103 during operation of clothes dryer system 101 to dry clothes. Filter assembly 109 includes a filter adapter, to which the filter material is attached. In this example, filter assembly 109 is positioned inline with the end of conduit 107 where conduit 107 previously connected to conduit 108, where conduit 108 extends up through floor 111. The interfacing side of the adapter opposite the filter material has an outside annular dimension just small enough to fit snugly inside of conduit 107 and may be removably installed therein and then removed for the purpose of removing lint accumulated in the filter portion of lint filter assembly 109. The side of the filter adapter adjacent to the filter material may have an outside diameter just larger than the outside diameter of conduit 108 so that conduit filter assembly 109 may be fitted snugly over conduit 108 where it is exposed above floor 111. A hose clamp or spring clamp may be used to secure the installation at both junctions.

Filter assembly 109 functions to remove lint and particulate matter escaping from filter 103 thus preventing it from collecting around the inner periphery of conduit section 108 and thereby significantly reducing restriction of air flow through exhaust to the outside. Filter assembly 109 is, in a preferred embodiment, easily removed for cleaning and replaced for reuse. Although filter assembly 109 is preferably provided as a secondary filter, it may also function as a primary lint filter if filter 103 is damaged or compromised. Filter assembly 109 may be provided as a secondary filter that, by virtue of standardized conduit dimensioning, may be reliably and easily installed in any standard exhaust of a drying system. Filter assembly 109 may include special adapter fittings for facilitating installation in existing clothes drying systems that have non-standard egress port and/or conduit sizes.

In this case, filter assembly 109, by virtue of a conduit adapter, is adapted to fit snugly over conduit section 108 until the interfacing rim of conduit 108 bottoms out inside the adapter. Flexible conduit section 107 fits snugly over the opposite side of the conduit adapter. The filtering portion of assembly 109 actually extends into conduit 108 to an extent that may vary according to filter design as will be further illustrated below.

Referring now to FIG. 1B, conduit section 108 protrudes through wall 110 instead of up through the floor as described above. In this example, filter assembly 109 is installed in the same location as described above. That is, between conduit sections 107 and 108. Therefore, the adapter portion facing conduit 108 in installation is female and the adapter portion opposite the filter and facing conduit 107 in installation is male. However, this should not be construed as a strict limitation of the invention, although it is a preferred embodiment. There are other possible variations to filter assembly 109 that may be provided to cause adaptation to conduit sizes that may vary from standard implementations. Moreover, the preferred location of installation illustrated in this embodiment and above in FIG. 1A should not be construed as a strict limitation of the invention as one with skill in the art will immediately recognize that filter assembly 109 may, in one embodiment, be installed at the egress point of exhaust from dryer system 101 instead of at the wall or floor duct without departing from the spirit and scope of the present invention. Generally speaking, conduit 107 is very short in length and is easily removed and may be cleaned relatively easily. On the other hand, conduit 108 is typically rigid, much longer than conduit 107, and is relatively inaccessible or hard to access for cleaning. Therefore, it is preferred that filter assembly 109 function to prevent lint buildup in conduit section 108 primarily.

Figure 2:
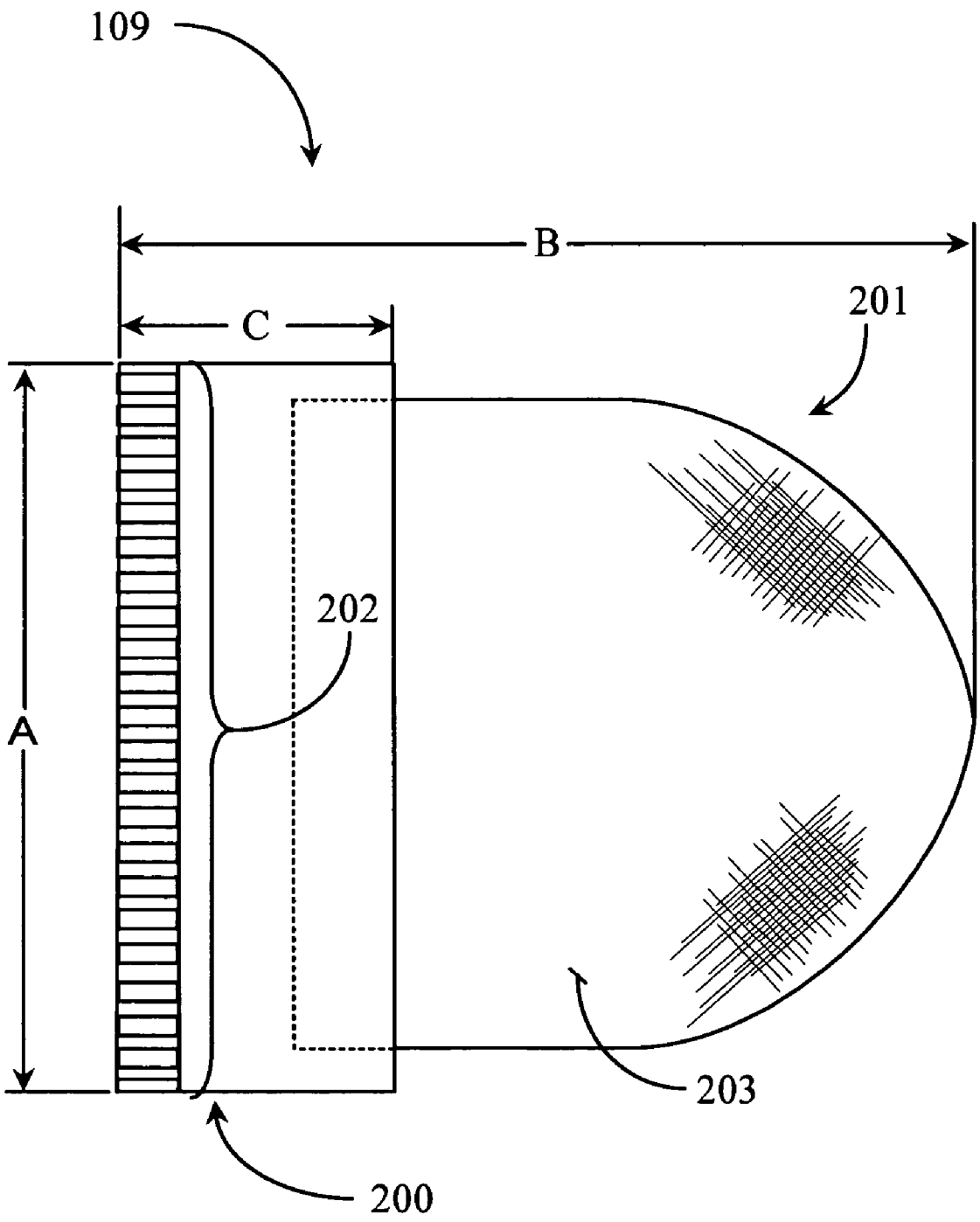
FIG. 2 is a side view of the lint filter assembly of FIG. 1 according to an embodiment of the present invention.

FIG. 2 is a side view of lint filter assembly 109 according to an embodiment of the present invention. Filter assembly 109 includes a filter conduit adapter 200. Adapter 200 is annular in construction and may be manufactured from galvanized sheet metal in one embodiment. In another embodiment, adapter 200 may be manufactured from polyvinyl chloride plastic (PVC) or some other polymer resin that may be hardened. Adapter 200 may be machined or molded to suit.

In this example, adapter 200 has two interfaces, a male interface and a female interface; both interfaces are dimensioned for standard fit to adjoining conduit interfaces. The male interface of adapter 200 is characterized by ribbing 202. The opposite side or female end is smooth. Nominal outside dimension A for adapter 200 may typically be about 4 inches in diameter although dimension A may be larger or smaller than 4 inches without departing from the spirit and scope of the present invention as required to facilitate conduit fitting. The male interface of adapter 200 may be held smaller than 4 inches in diameter, perhaps tapered down, such that it may snugly fit inside of a conduit section measuring 4 inches inside diameter to an extent less than the length of adapter 200 or dimension C. The female side of adapter 200 may have an inside diameter of 4 inches, perhaps tapering out such that a conventionally tapered 4 inch outside diameter (OD) conduit might fit snugly therein to an extent less than length C. Dimension C, in this embodiment, is about 1 and three quarter inches but may be greater without departing from the spirit and scope of the present invention. An overall dimension B of filter assembly 109, in one embodiment, is about 4 and one half inches long, but may be greater in length without departing from the spirit and scope of the present invention.

In one embodiment adapter 200 is manufactured with a step wall (not illustrated) around the inner diameter oriented substantially perpendicular to the longitudinal axis thereof such that the step formed therein functions as a stop for the interfacing edge of the conduit inserted therein during installation. Alternatively, adapter 200 may have a dimension A that is substantially uniform across length C and either side of the adapter may be used as a male interface with hose clamps or spring clamps used to secure the conduit there over. Likewise, either side of adapter 202 may be a female interface. There are several possible fitting schemas that may be contemplated.

A lint filter 201 is provided and adapted to be removably or permanently affixed to one side of adapter 200. Filter 201 may be a screen mesh filter or a filter of a more flexible type like plastic or nylon. In this example, filter 201 is annular in cross section and tapers to a closed end opposite adapter 200. Filter 201 may be affixed at the open end thereof to a support ring (not illustrated) mounted or welded in concentric fashion on the inside of adapter 200. Filter 201 may be welded (if metal), or glued (if nylon) to the support ring in a way that insertion of conduit into adapter 200 over filter 201 does not bind the filter. Alternately, filter 201 may be affixed to the inside wall of adapter 200 wherein the side of the adapter supporting the filter is used as a male interface with adjoining conduit.

In another embodiment, filter 201 may be affixed to a flange that can be inserted into and retained inside adapter 200 such as by snapping in place or by clamping in place. In the latter embodiment, filter 201 may be separated from adapter 200 in the installation whereupon the filter may be cleaned and re-inserted into place. In a variation of the latter embodiment, the flange may be a rubber flange that has memory-resilient properties and that may be collapsed for insertion into adapter 200 whereupon when released expands to abut against the inner wall of adapter 200. In this variant, an annular recess or rib may be formed or otherwise provided around the inside wall of adapter 200 in orientation substantially perpendicular to the longitudinal axis thereof. Such a recess or rib may serve as a positioning aid to the filter. Also in this embodiment the filter may be easily pulled out from the inside adapter causing the flange to collapse under the force of pull without requiring any unclamping motion or other disassembly procedures.

Figure 3:
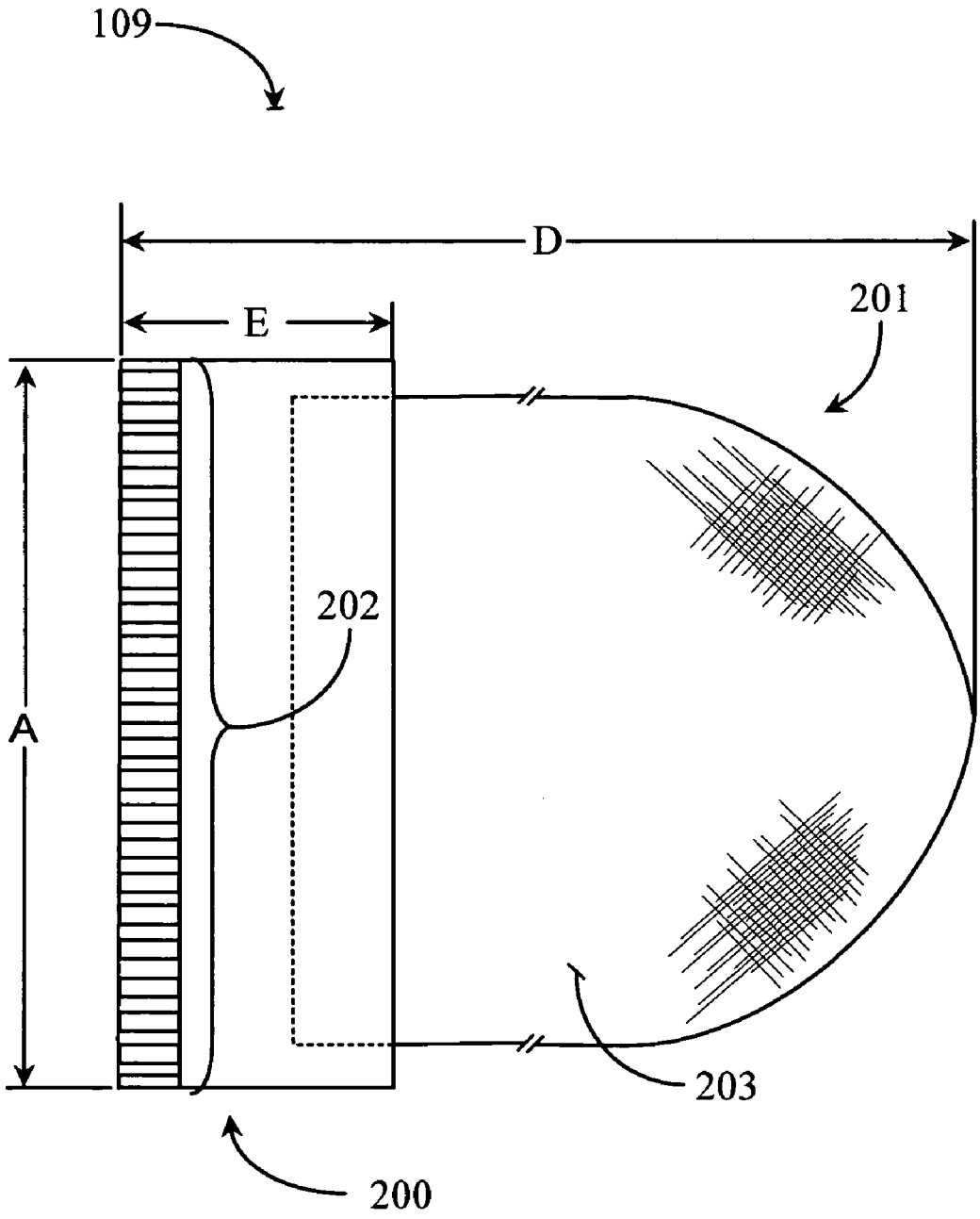
FIG. 3 is a side view of the lint filter assembly of FIG. 2 according to another embodiment of the present invention.

FIG. 3 is a side view of a lint filter assembly 109 according to another embodiment of the present invention. Filter assembly 109 may be extended somewhat in length dimensioning to maximize filtering area without causing more space to be required between the back wall of the clothes dryer system and the facing building wall. For example, a dimension E illustrated as the length of adapter 200 in this example may be about 3 inches while overall dimension D may be about 6 and one half inches without departing from the spirit and scope of the present invention. Such length extension from the embodiment of FIG. 2 may still be accommodated in a first section of a standard 4-inch diameter fixed 90-degree elbow before the bend.

Figure 4:
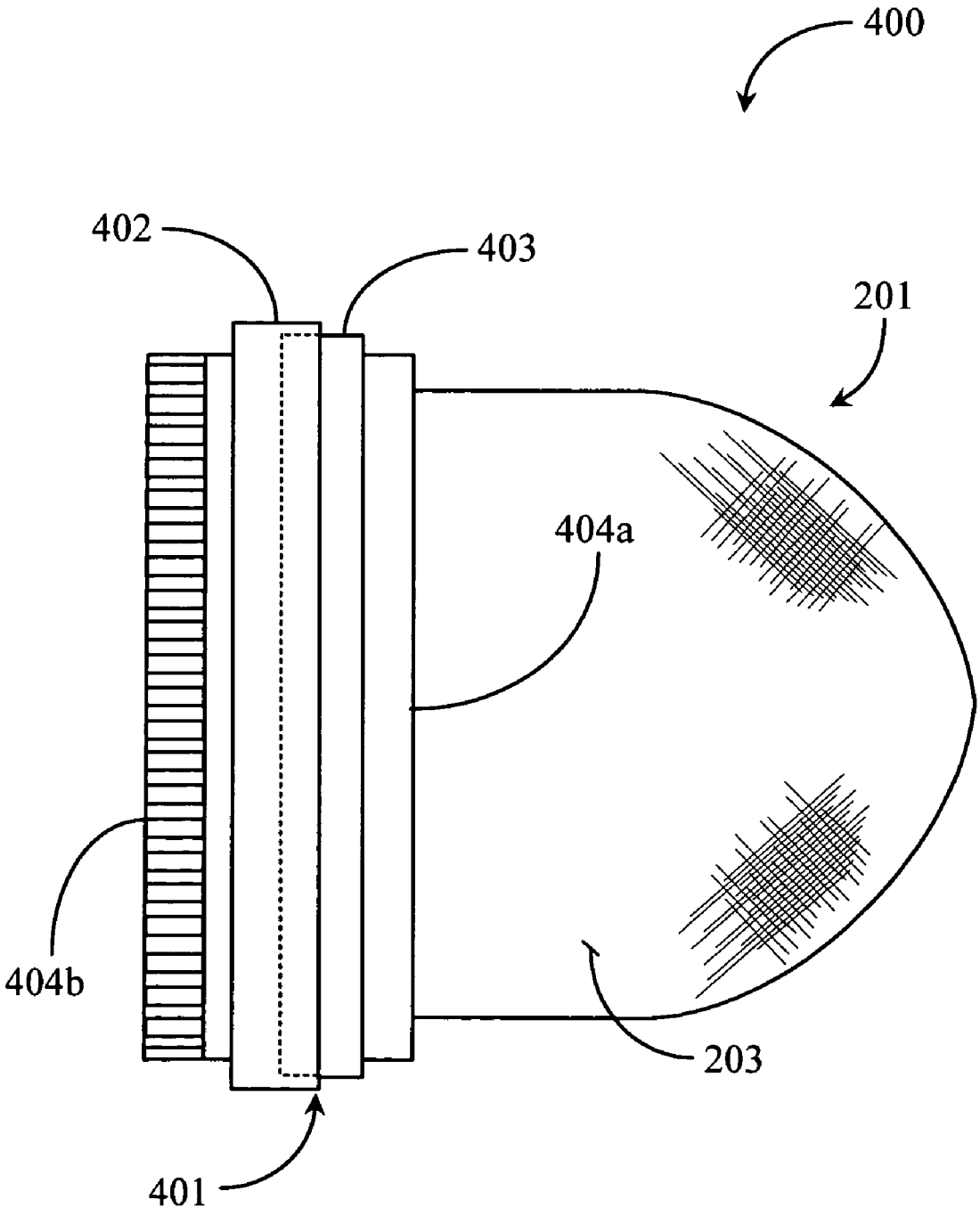
FIG. 4 is a side view of a lint filter 400 and quick adapter 401 according to an embodiment of the present invention.

FIG. 4 is a side view of a lint filter assembly 400 and quick adapter 401 according to an embodiment of the present invention. Filter assembly 400 may be similar in construction, materials, and dimensioning to filter assembly 109 as described in various embodiments above with an exception of quick filter adapter 401. Adapter 401 is adapted as two adaptor portions that may be connected together by a threaded connection. A female adaptor seat 402 has threading provided internally and adapted to accept threading provided externally about a male adapter plug 403. Preferably, adapter seat 402 may be formed separately from male conduit portion 404*b* to allow adapter seat 402 to be operatively unscrewed from adapter plug 403. Preferably, adapter seat 402 and male conduit portion 404*b* are formed from PVC, although other materials are contemplated. Preferably, adaptor plug 403 is contiguously formed with a female conduit adaptor portion 404*a* from PVC or other material. Quick adapter 401 may be of an overall length subtracting the overall assembled length of seat 402 and plug 403 so that conduit adapter portions 404*b* and 404*a* retain sufficient land surface for facilitating secure connection to conduit.

In this embodiment, adaptor seat 402 and male conduit adapter portion 404*b* may remain affixed to flexible or rigid conduit 107 extending from the interfacing wall of a clothes dryer system 101. A user may disconnect seat 402 from plug 403 thereby easily removing filter 201 for cleaning without removing plug 403 from conduit 108. Removal of lint from filter material 203 may be performed by gathering the lint together for removal much in the same fashion as is typically performed in cleaning a primary lint filter. In one embodiment, adapter plug 403 has two or more external "bumps" formed strategically thereon that are in alignment with a like number of "L" slots provided in the wall of seat 402. Instead of threading seat 402 onto plug 403, a user may align plug 403 to seat 402 (bumps to slots) and then may push seat 402 onto plug 403 until it bottoms out, twisting the seat in a last step to lock it into place. Such quick connect schemes are common in the art of component assembly and are practical for use in place of a threaded connection in at least one embodiment.

Figure 5:
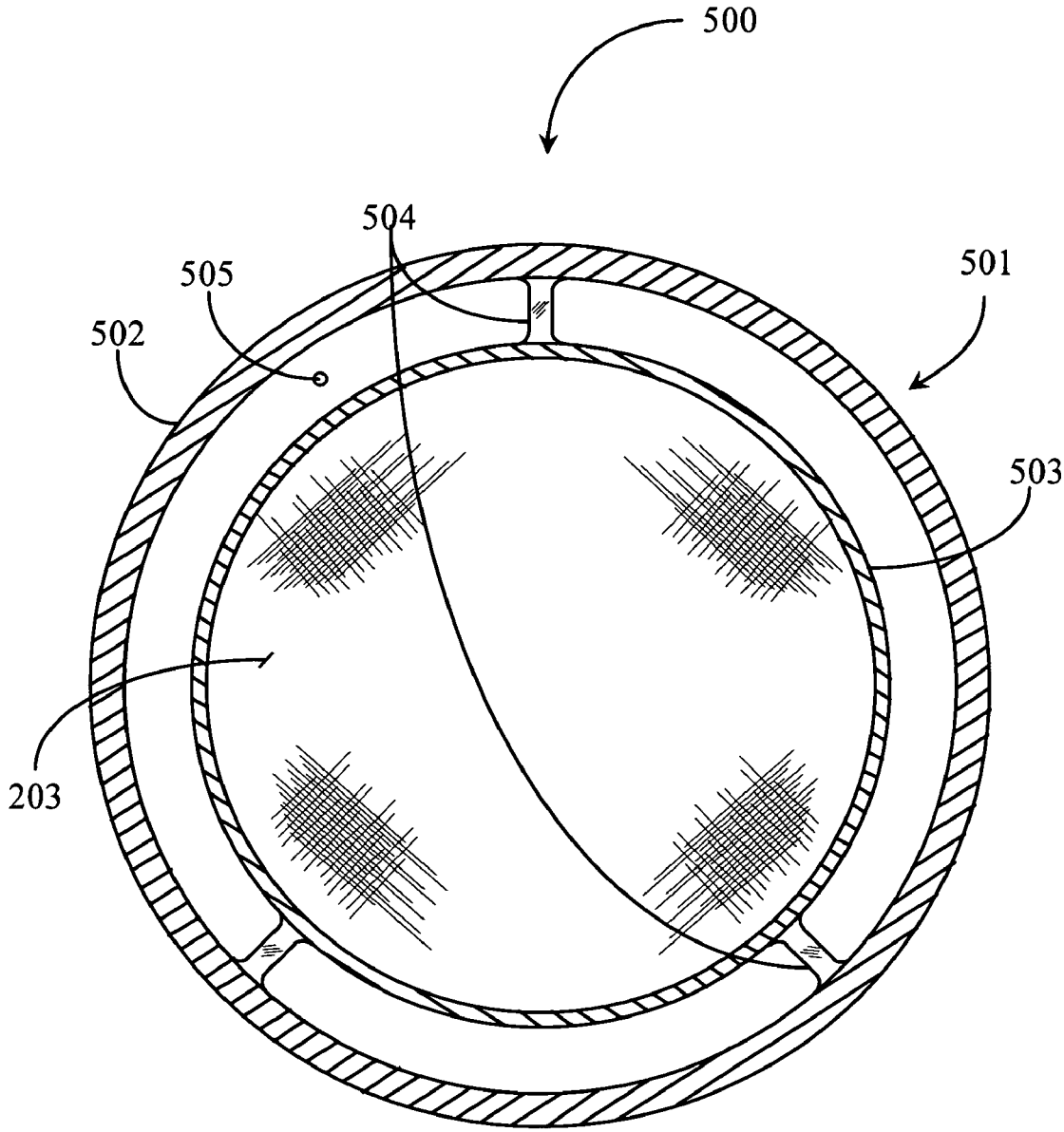
FIG. 5 is a cross-section of a lint filter and adapter according to yet another embodiment of the present invention.

FIG. 5 is a cross-section of a lint filter and adapter 500 according to yet another embodiment of the present invention. Adapter 500 may be formed of galvanized sheet metal or PVC materials previously described with respect to components of other embodiments discussed. In this embodiment, adapter 500 includes an inner support ring 503 concentrically aligned with an outer conduit interface 502. Ring 503 is supported in concentric alignment with conduit interface 502 via a plurality of support ribs 504. Support ribs 504 may be contiguously formed to both ring 503 and conduit interface 502 in an embodiment wherein PVC or some other polymer is the material used to manufacture ring 500. In an embodiment wherein sheet metal is used, adapter 500 may be assembled via welding.

In one embodiment, conduit interface 502 may be externally threaded for fit with adapter seat 402 as described further above. In another embodiment, adapter ring 500 includes a male adapter side and a female adapter side as was described further above with respect to filter assembly 109 of FIG. 2. In this example, filter material 203 is fastened directly to ring 503 and may be welded thereto or glued thereto as described earlier.

The concentric alignment of ring 503 to conduit adapter 502 allows for a relative open space 505 extending around the periphery there between. Space 505 is completely open except for ribs 504. Space 505 is adapted to allow some of the hot moist air from the clothes dryer exhaust to pass there through unfiltered. In this example, filter material 203 does not capture all of the remaining lint but close to all of the remaining lint that might escape a primary filter. The purpose then of space 505 is to allow an unobstructed air passage around filter material 203 in the event that filter material 203 becomes severely clogged with lint such as for example, through neglect in timely cleaning of filter material 203. In this way, moist air does not backup if filter material 203 becomes clogged.

The filter system of the present invention designed as a secondary filter does not need to be cleaned near as frequently as a primary filter should be cleaned. The primary filter, if in good condition, should filter out much of the lint and particulate exhausted from the clothes dryer drum. The filter of the invention simply filters out what may be left over from primary filtering. A primary filter should be cleaned after every drying cycle to remove lint. The secondary filter of the present invention may continue collecting lint through many drying cycles before requiring removal of lint accumulated on the filter material. If the filter of the present invention is functioning as a primary filter, then it should be cleaned after every drying cycle.

The method and apparatus of the present invention may be provided as an accessory that is easily installable to virtually any clothes drying system that uses a system of conduit to exhaust moist heated air to the outside without departing from the spirit and scope of the present invention. The filter system of the invention may be provided with one or more accessories like conduit sections and adapter components so that non-standard exhaust configurations generic to some clothes dryer systems may be adapted with the secondary filtering capability. Moreover, the filter system of the present invention may be provided in different sizes for different capacities in clothes drying systems. For example, a certain commercial dryer might have larger exhaust conduit than a consumer version of the system.

The filtering system of the present invention may be provided using some or all of the components described above in various embodiments. The spirit and scope of the present invention shall be limited only by the claims that follow.

What is claimed is:

1. In a clothes dryer system having a first round exhaust conduit (107) ending in a female end and a continuing second round exhaust conduit (108) with a male end, a secondary lint filter assembly comprising:

a conduit adapter comprising:

a cylindrical body having an overall outer diameter and an inner diameter, a first end contiguous with the outer diameter with a male conduit adapter portion just small enough to fit snugly inside the female end of the first round exhaust conduit and a second end having a female conduit adapter portion (404*a*) with a diameter just larger than the diameter of the male end of the second round exhaust conduit, to fit snugly over the male end of the second round exhaust conduit; and a female threaded interface contiguous with the inner diameter; and a removable filtering assembly comprising:

an outer adapter ring (502) externally threaded to engage the female threaded interface contiguous with the inner diameter of the conduit adapter above;

an inner support ring (503) concentric with the outer adapter ring and joined to the outer adapter ring by a plurality of support ribs (504), providing a substantially open annulus (505) between the outer adapter ring and the inner support ring; and a lint filter element (201) formed of filter material (203) joined directly around the periphery of inner support ring (503);

wherein, with the secondary lint filter assembly joined between the ends of the first and second round exhaust conduits, the lint filter element traps lint escaping from the clothes dryer, and the open annulus provides a relatively unobstructed air passage around the lint filter should the lint filter become clogged.

* * * * *